US005393940A

United States Patent [19]

Bedard, Jr. et al.

[11] Patent Number: 5,393,940

[45] Date of Patent: Feb. 28, 1995

[54] APPARATUS AND METHOD FOR REDUCING ACOUSTIC OR ELECTROMAGNETIC ENERGY IN THE VICINITY OF A SOURCE

[75] Inventors: Alfred J. Bedard, Jr.; James H. Churnside; Randall T. Nishiyama, all of Boulder, Colo.

[73] Assignee: The United States of America as represented by the Secretary of Commerce, Washington, D.C.

[21] Appl. No.: 800,237

[22] Filed: Nov. 29, 1991

[51] Int. Cl.[6] ..... G10K 11/00

[52] U.S. Cl. ..... 181/210; 181/151; 181/284; 181/295; 256/13.1

[58] Field of Search ..... 181/151, 153, 210, 284, 181/295; 256/11, 13.1

[56] References Cited

U.S. PATENT DOCUMENTS

| | | | |
|---|---|---|---|
| 2,652,127 | 9/1953 | Johnston | 181/247 |
| 3,557,901 | 1/1971 | Young | 181/176 |
| 4,095,669 | 1/1978 | Bond, Sr. | 181/210 |
| 4,175,639 | 11/1979 | Wirt | 181/210 |
| 4,219,101 | 8/1980 | Valsvik | 181/286 |
| 4,228,867 | 10/1980 | Wirt | 181/210 |
| 4,308,933 | 1/1982 | Hahn et al. | 181/210 |
| 4,436,179 | 3/1984 | Yamamoto et al. | 181/210 |
| 4,872,528 | 10/1989 | Goplen et al. | 181/228 |
| 4,898,260 | 2/1990 | Fang | 181/148 |

OTHER PUBLICATIONS

"The Control Of Diffracted Sound By Means Of Thnadners (Shaped Noise Barriers)", L. S. Wirt (1979) (no month) pp. 73–83, 86–88.

*Primary Examiner*—Michael L. Gellner
*Assistant Examiner*—Eddie C. Lee
*Attorney, Agent, or Firm*—Harold A. Burdick; Diana M. Cox

[57] ABSTRACT

An apparatus and method are disclosed for reducing electromagnetic or acoustic energy scattered in both the near and more generalized vicinity of a source thereof by various phenomena including atmospheric and weather-related effects and diffraction at the top edge of heretofore known barriers. The apparatus includes a member configured for engagement with the top edge of a barrier, with the member having a patterned edge defining a plurality of portions jutting away from the top edge of the barrier and in a direction having a component toward the source, preferably substantially in a more or less horizontal plane with the top edge.

17 Claims, 3 Drawing Sheets

APPARATUS AND METHOD FOR REDUCING ACOUSTIC OR ELECTROMAGNETIC ENERGY IN THE VICINITY OF A SOURCE

FIELD OF THE INVENTION

This invention relates to acoustic barriers and, more particularly, relates to apparatus and methods for reducing acoustic or electromagnetic energy in both the immediate and more generalized vicinity of a source of the energy.

BACKGROUND OF THE INVENTION

A variety of barriers and other devices for attenuation of acoustic energy generated by a source have been heretofore suggested and/or utilized for a number of differing applications where complete enclosure of the source is either undesirable or impractical. Many, such as berms and fencing, do little more than provide absorbing structure adjacent to the source. In the case of barriers having a top edge, such as fencing and other panel-type designs, diffraction of acoustic or electromagnetic energy at the barrier edge can actually exacerbate the problem which the barrier is intended, at least in part, to resolve by decreasing the angle at which energy is launched.

It is well known that a variety of atmospheric conditions and/or effects can trap, scatter, reflect or refract energy, such as acoustic energy, and return that energy to the earth's surface, often some distance from the source. This is particularly the case with energy launched at relatively low angles (for example, less than about 45 degrees), since the steeper the angle of launch (relative to the horizon) the less it is likely such atmospheric conditions and/or effects will act to redirect the energy back toward the earth. It would thus be desirable to reduce such energy launched at low angles.

Heretofore known barrier designs have included various baffle-type designs (see U.S. Pat. No. 4,095,669), absorbing and or reflective designs (see U.S. Pat. No. 4,219,101), and complex geometries directed to shifting the phase of and/or refracting an acoustic wave (see U.S. Pat. No. 4,436,179). Such designs have not addressed the problem of diffraction of acoustic energy to lower launch angles at the upper edges of such barriers, and thus have not proven entirely satisfactory for many applications.

Other devices have been heretofore suggested and or utilized for silencing noise inherent in certain mechanical operations, for example exhaust system noise (see U.S. Pat. Nos. 2,652,127 and 4,872,528). Such devices have not, however, utilized the geometry suggested herein to resolve the problems addressed thereby.

At least one noise barrier has been suggested which utilizes controlled diffraction to deepen the acoustical shadow adjacent to the barrier by providing vertical, spaced, members adjacent to a source of noise designed to introduce destructive interference (see U.S. Pat. Nos. 4,175,639 and 4,228,867). This barrier design, however, actually seems to increase the intensity of sound launched at low angles (relative to barriers without the extensions), and thus does little to improve noise reduction at greater distances from the source.

Further improvement in such barriers and other devices could thus still be utilized.

SUMMARY OF THE INVENTION

This invention provides an apparatus and method for reducing electromagnetic or acoustic energy in both the near and more generalized vicinity of a source of the energy (at substantially all surface locations where such energy can be sensed) by altering the diffracting characteristics of the top edge of a barrier normally utilized in association with such energy sources to reduce energy levels in the surrounding area.

Particularly effective to reduce such energy scattered or trapped by a variety of effects (such as temperature inversions, wind and the like) and returned to the surface at longer distances from the source, the apparatus and method function to absorb and/or redirect energy emitted at and/or diffracted to lower launch angles (45 degrees or less relative to the horizon).

The apparatus is affixable to a support structure adjacent to an uppermost edge of the structure, and has a member configured for angular engagement adjacent to the uppermost edge of the support structure. The member has a patterned edge spaced from the uppermost edge of the support structure when the support structure and the member are engaged, the patterned edge defining a plurality of jutting portions of the member extending in a direction having a component toward the source.

The jutting portions are preferably planar having a substantially triangular overall surface configuration, and preferably extend from the uppermost edge about one third to one half the distance of the barrier radius (when used in association with curvilinear enclosure barriers) with a base width of about one half the wavelength of the energy emitted by the source.

Where used in association with barrier systems not so configured, the jutting portions may be idealized for the wavelength of energy most predominant from the source, having a base and length from base to tip of between one quarter and one half of such wavelength.

The apparatus may be separately provided, or may be provided with a barrier having a relatively even surface, the surface for orientation toward, and direct exposure to energy from, the source.

The method includes the steps of positioning a structure having a top edge in a selected spaced relationship with the source so that a surface of the structure is oriented toward, and directly exposed to energy from, the source, and altering diffracting characteristics of the top edge of the structure to reduce energy launched at selected angles.

It is therefore an object of this invention to provide an improved apparatus and method for reducing acoustic or electromagnetic energy in the vicinity of a source.

It is another object of this invention to provide an apparatus and method for reducing the amount and/or intensity of acoustic energy returned to the earth by atmospheric conditions and/or effects at a distance from the source.

It is still another object of this invention to provide an apparatus and method for reducing acoustic or electromagnetic energy in the vicinity of a source by altering the diffracting characteristics of the top edge of a barrier adjacent to the source.

It is still another object of this invention to provide an apparatus positionable on a support structure for reducing acoustic or electromagnetic energy in the vicinity of a source, the apparatus being affixable to the support structure adjacent to an uppermost edge of the structure, the apparatus including a member configured for angular engagement adjacent to the uppermost edge of the support structure and having a patterned edge spaced from the uppermost edge of the support structure when the support structure and the member are engaged, the patterned edge defining a plurality of jutting portions of the member.

It is another object of this invention to provide an apparatus for reducing acoustic energy in the vicinity of a source thereof which includes a substantially planar member having a patterned edge and extending from the top edge of a barrier in a direction having a component toward the source.

It is yet another object of this invention to provide an apparatus for reducing acoustic or electromagnetic energy in the vicinity of a source which includes a barrier for separating the source and a selected area, the barrier having a top edge and a relatively even surface, the surface for orientation toward, and direct exposure to energy from, the source, and which provides means for altering diffracting characteristics of the top edge of the barrier including a plurality of jutting portions adjacent to the top edge and extending away from the top edge in a direction having a component toward the source.

It is still another object of this invention to provide a method for reducing acoustic or electromagnetic energy in the vicinity of a source including the steps of positioning a structure having a top edge in a selected spaced relationship with the source so that a surface of the structure is oriented toward, and directly exposed to energy from, the source, and altering diffracting characteristics of the top edge of the structure to reduce energy launched at selected, relatively low, angles.

With these and other objects in view, which will become apparent to one skilled in the art as the description proceeds, this invention resides in the novel construction, combination, arrangement of parts and method substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
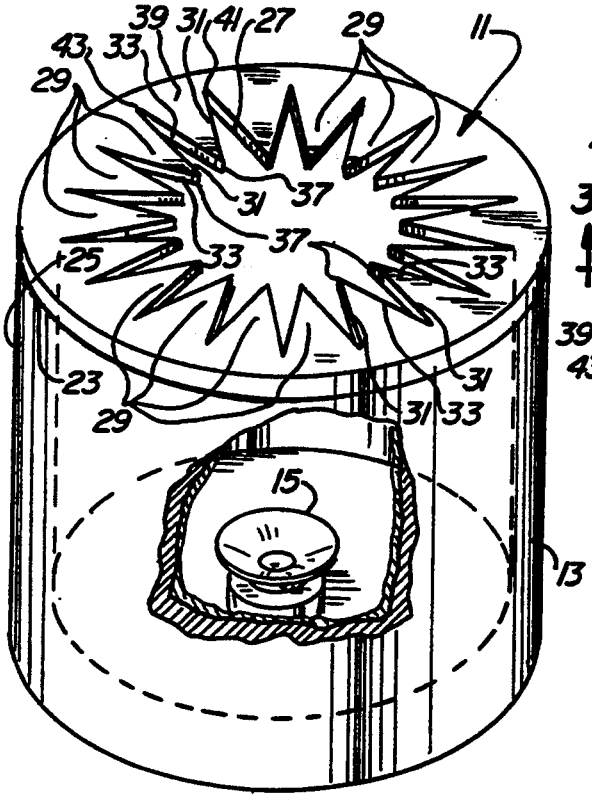
FIG. 1 is a perspective view of the apparatus of this invention for use with a piece of equipment.
Figure 2:
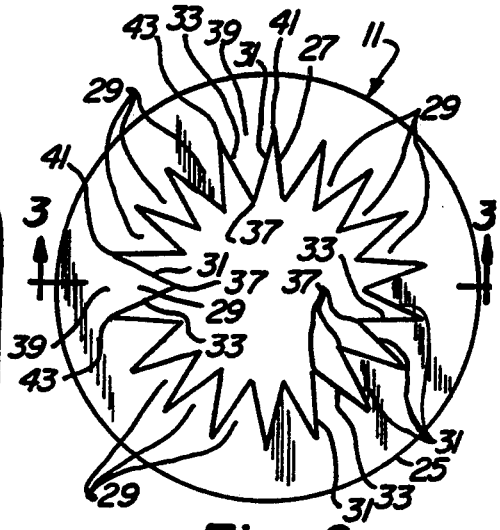
FIG. 2 is a top view of the apparatus in FIG. 1.
Figure 3:
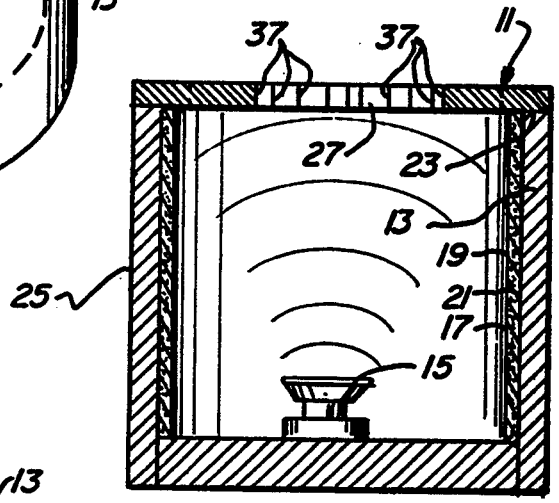
FIG. 3 is a sectional view taken through section lines 3—3 of FIG. 2.

FIGS. 1 through 3 illustrate apparatus 11 of this invention supported on barrier structure 13 surrounding acoustic or electromagnetic energy source 15 (for example, in the case of an acoustic source, a radio, or radar, acoustic sounding system or other acoustic measuring device, a transformer, air conditioner, or the like requiring an open area for either transmission of energy or heat venting). While the apparatus of this invention will be described herein as this description proceeds in association with acoustic energy sources, it is to be realized that the principles thereof could be as well applied to electromagnetic energy sources of various kinds, for example to electromagnetic radars where absorbing enclosures are utilized to reduce energy scattered back from objects appearing in side lobes.

Apparatus 11 and barrier structure 13 can be made of any sturdy material, such as concrete, construction foam, wood, or certain kinds of metal or plastic. Barrier 13 typically has a height relative to its position and distance from source 15 selected to intercept energy from side lobes launched from the source up to at least approximately 45 degrees (where utilized in other applications requiring some degree of idealization of design, the height would be at least approximately two meters). Barrier 13 has a relatively smooth surface 17 facing toward the source, surface 17 being in this case an acoustically absorbant material layer 19 attached to inward facing surface 21. Alternately, some absorbing surfaces are deliberately roughened, but with the overall surface expanse defined being relatively even.

Apparatus 11 is affixed at uppermost edge 23 of barrier 13 substantially normal to surface 17, utilizing any convenient means, so that the apparatus extends in a direction having a component toward the source from, and substantially in the plane of, top edge 23. Apparatus 11 is a substantially planar member, or series of members, and includes a first edge 25 configured to substantially correspond to the contours of barrier 13 and a second, patterned, edge 27 spaced from top edge 23 of barrier 13. Patterned edge 27 defines a plurality of jutting portions 29 extending away from top edge 23.

Jutting portions 29 are preferably generally triangular or petal shaped, having upper and lower substantially planar surfaces, and each including converging edges 31 and 33 meeting at tip 37, a base 39 of each portion 29 being defined between ends 41 and 43 of edges 31 and 33, respectively. Each of edges 31/33 preferably converge with an edge of an adjacent one of jutting portions 29. Jutting portions 29 are preferably sized to maximize effectiveness with relationship to the wavelength, or wavelength of interest, of energy emanating from the source, with a length from base to tip of about one third to one half of the radius of the barrier and a base width of about one quarter to one half of the wavelength of the energy.

For use with square, octagonal, or other enclosure-type barrier geometries, an equivalent of the radius may be estimated. Where the enclosed area makes such sizing impractical, the length of jutting portions 29 from base to tip is preferably about one quarter to one half the wavelength of interest. For use with irregularly enclosed areas or with unenclosed areas (such as construction sites, mining or milling sites, raceways, outdoor concert facilities, and roadways), and/or where a wide spectrum of wavelengths of noise may be present, the width of base 39 and the length from base 39 to tip 37 is preferably from about one quarter to one half of the wavelength of the noise to be controlled (for example, along a roadway as illustrated in FIG. 4, where the wavelength of noise of interest is between one and two kHz, the base width and length of jutting portions 29 would be between 15 and 30 cm).

Figure 4:
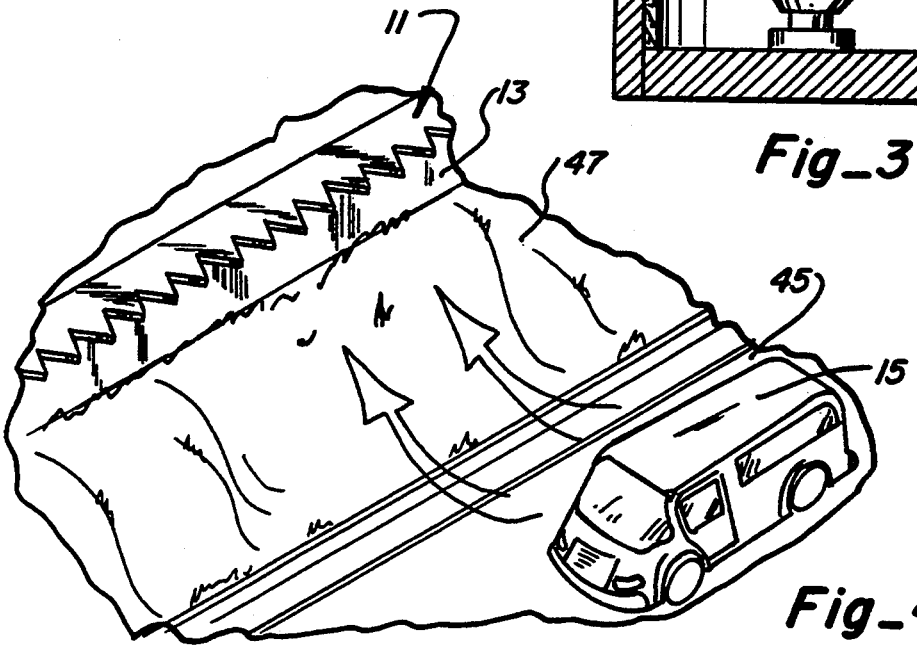
FIG. 4 is a perspective view of the apparatus of this invention utilized along a roadway.
Figure 5:
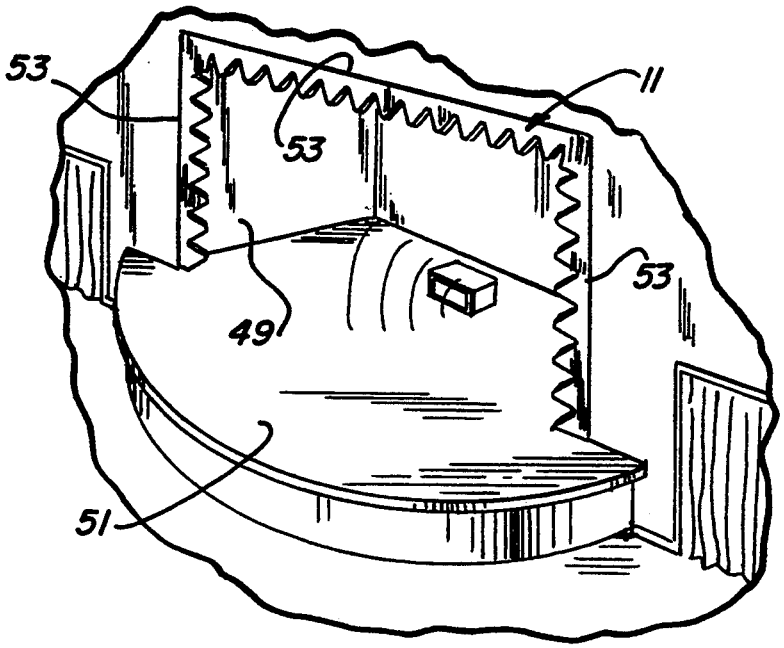
FIG. 5 is a perspective view of the apparatus of this invention utilized with a stage structure.

FIG. 4 shows use of apparatus 11 along roadway 45. In such application barrier 13 may be constructed on berm 47 to further enhance noise reduction. FIG. 5 shows apparatus 11 mounted to side walls 49 of an outdoor stage structure 51 to effect reduction of acoustic energy diffraction at side wall edges 53.

Figure 6A:
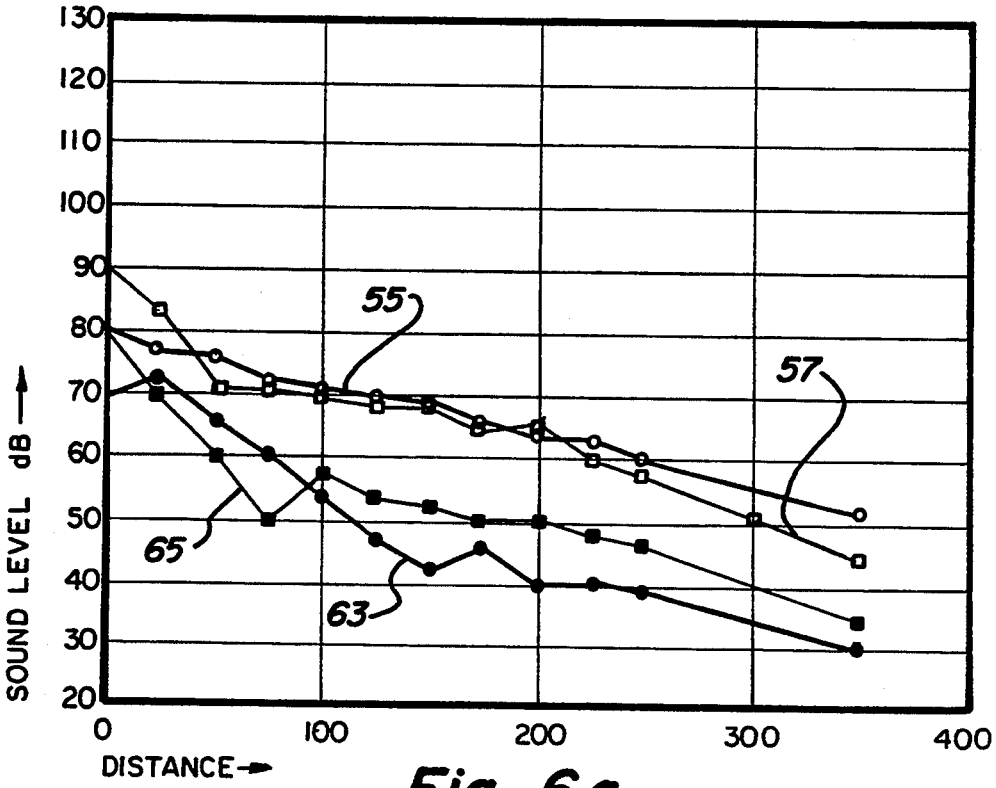
FIGS. 6*a* and 6*b* are graphic illustrations showing the benefit of use of the apparatus of this invention relative to a panel-type barrier.
Figure 6B:
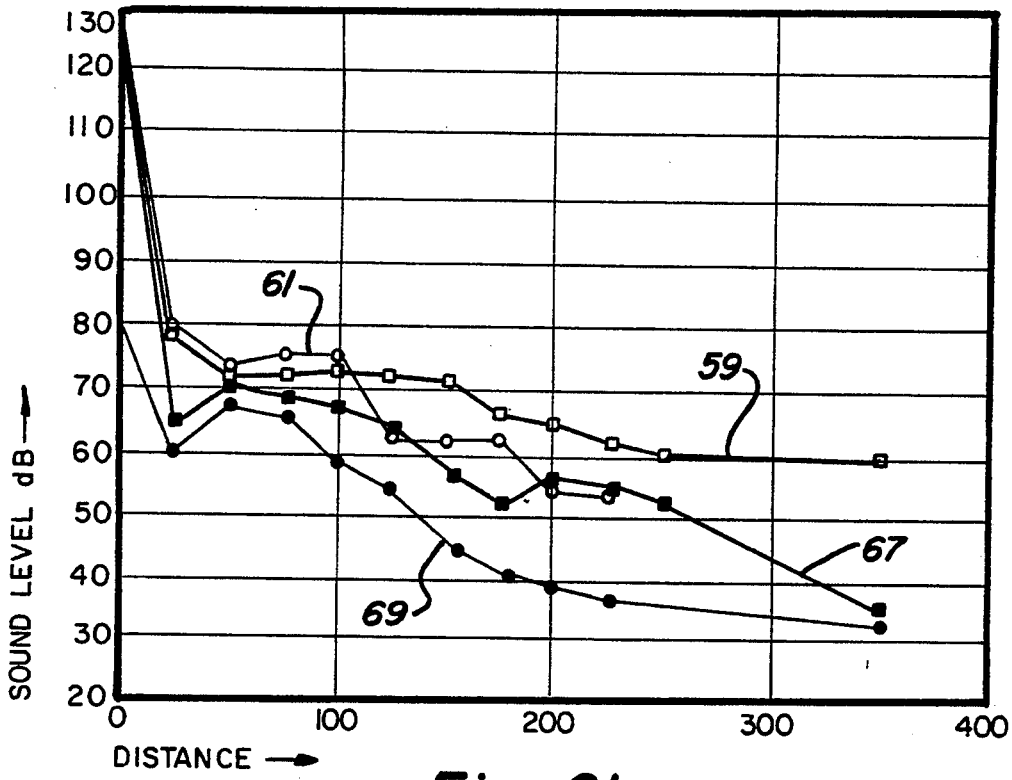

FIGS. 6*a* and 6*b* show the improvements in noise reduction realized over plain panel type barriers. Sound levels were measured at selected distances (measured in feet) from the source at four different times, readings being taken at each time for a barrier without apparatus 11 (designated as lines 55, 57, 59, and 61) and with the apparatus (designated as lines 63, 65, 67, and 69, respectively). An overall improvement in the range of 10 dB or greater was observed on most occasions, with noise reduction benefits often increasing with distance from the source.

Figure 7:
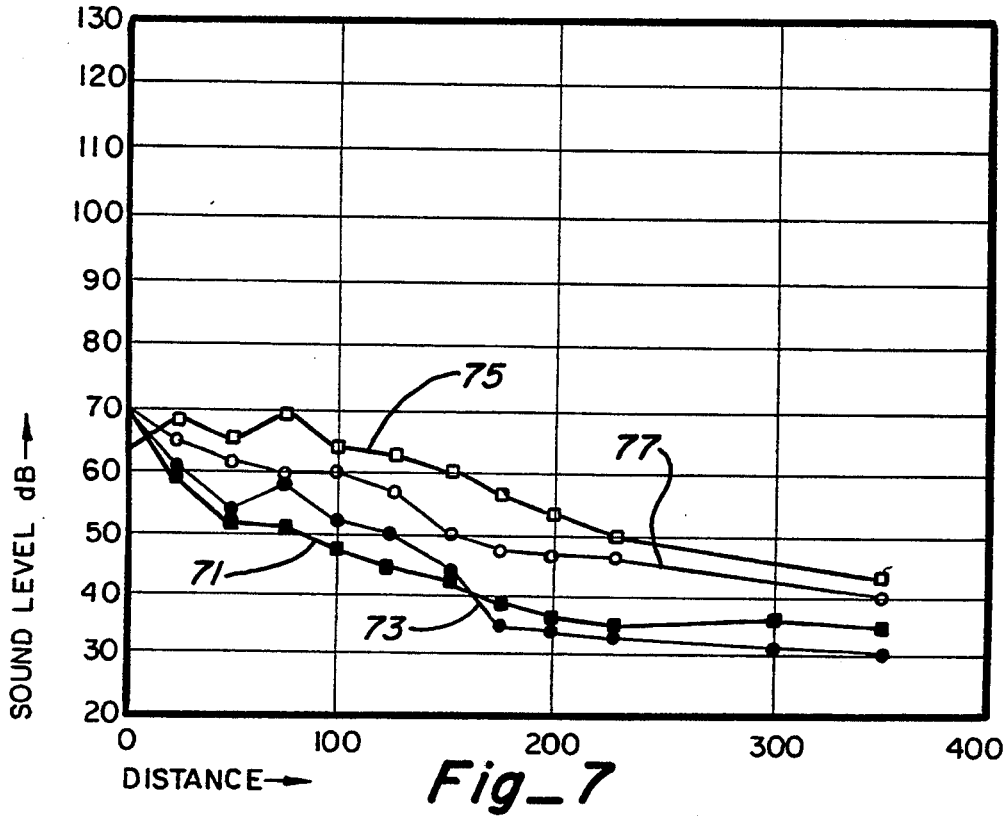
FIGS. 7 is a graphic illustration showing the benefit of use of the apparatus of this invention relative to another well known barrier design.

FIG. 7 shows the benefits observed by use of apparatus 11 (lines 71 and 73) compared to another (lines 75 and 77, respectively) well known noise reduction barrier design (see U.S. Pat. No. 4,175,639). Again, improvements in the 10 dB range were observed.

As may be appreciated from the forgoing, an improved device and method for reducing acoustic or electromagnetic energy in the vicinity of a source has been provided which beneficially alters diffracting characteristics of the uppermost edge of known barriers.

What is claimed is:

1. An apparatus positionable on a support structure for reducing one of acoustic and electromagnetic energy in a vicinity opposite said apparatus from a source thereof by directly intercepting energy launched from the source at selected launch angles which would otherwise be more likely to be redirected to the vicinity by atmospheric conditions, said apparatus being affixable to the support structure adjacent to an uppermost edge of the structure, said apparatus having a patterned edge, said patterned edge defined by a plurality of jutting portions each including first and second edge portions extending in a direction having a component toward the source and away from the support structure from a position adjacent to the uppermost edge of the support structure and converging at a position spaced from said uppermost edge in said direction, said converging position of each said jutting portion being spaced from said converging position of any other said jutting portion; wherein each of said jutting portions have a substantially planar surface between said edge portions; and wherein the support structure has a surface facing the source, said planar surface of said jutting portions and the surface of the support structure being substantially normal relative to each other and wherein no substantial part of the support structure extends above said apparatus when engaged with the support structure.

2. The apparatus of claim 1 wherein each of said edge portions also converges with an edge portion of an adjacent one of said jutting portions.

3. The apparatus of claim 1 wherein said jutting portions have upper and lower substantially planar surfaces extending from adjacent to the uppermost edge of the support structure without any additional structural elements in contact therewith.

4. The apparatus of claim 1 wherein the energy includes a wave length of interest and wherein each of said jutting portions has a base area having a width of between about one quarter and one half of the wavelength of interest of the energy to be reduced.

5. The apparatus of claim 4 wherein the support structure is positioned a selected distance from the source, each of said jutting portions having a length between said base area and a position at said patterened edge of between about one third and one half of the distance.

6. An apparatus for reducing one of acoustic and electromagnetic energy in a vicinity opposite said apparatus from a source thereof by directly intercepting energy launched from the source at selected launch angles which would otherwise be more likely to be redirected to the vicinity by atmospheric conditions, said apparatus comprising:

barrier means for separating the source and a selected area, said barrier means having a top edge and a surface, said surface for orientation toward, and direct exposure to energy from, the source; and means for altering diffracting characteristics of said top edge of said barrier means including a plurality of substantially planar jutting portions originating at a position spaced in a direction having a component toward the source from said top edge of said barrier means and defining a patterned outermost edge spaced from said top edge of said barrier means in said direction.

7. The apparatus of claim 6 further comprising an acoustically absorbant material at said surface of said barrier means.

8. The apparatus of claim 6 wherein said jutting portions have a substantially planar lower surface extending substantially normal to said surface of said barrier means.

9. The apparatus of claim 8 wherein each of said jutting portions has a base area defined between converging edge portions of said patterned edge, said converging edge portions meeting at a tip.

10. The apparatus of claim 8 wherein the energy has a wavelength of interest and wherein said lower surface of each of said jutting portions has a base width and a length each of between about one quarter and one half the wavelength of interest of energy to be reduced.

11. The apparatus of claim 6 wherein said means for altering diffracting characteristics and said barrier means are connected so that no related structure extends above said jutting portions.

12. The apparatus of claim 6 wherein said patterned edge is in a plane substantially normal to said top edge of said barrier means.

13. A method for reducing one of acoustic and electromagnetic energy in a vicinity of a source thereof, the method comprising the steps of:

positioning a barrier structure having a top edge between the source and the vicinity and in a selected spaced relationship with the source; and directly intercepting energy launched from the source at selected launch angles and altering diffracting characteristics of said top edge of said barrier structure to reduce energy diffracted to different angles thereby, said energy launched at selected angles and diffracted to different angles being otherwise more likely to be redirected to the vicinity by atmospheric conditions, by positioning a substantially planar member at said top edge of said structure, said member having a width defined between said top edge when positioned and a patterned edge defined by a plurality of jutting portions, said member extending away from said top edge in a direction along the entire width of the member having a component toward the source.

14. The method of claim 13 wherein said angles are low launch angles.

15. The method of claim 14 wherein said angles are about 45 degrees and less relative to a horizon.

16. The method of claim 13 wherein said planar member and said structure are positioned substantially normal relative to one another.

17. The method of claim 16 further comprising the step of more predominantly exposing said patterned edge rather than said top edge to the energy from the source.

* * * * *